US005199388A

United States Patent [19]

Bailey

[11] Patent Number: 5,199,388

[45] Date of Patent: Apr. 6, 1993

[54] AXIAL FAN FLYWHEEL

[75] Inventor: Francis V. Bailey, Racine, Wis.

[73] Assignee: Outboard Marine Corporation, Waukegan, Ill.

[21] Appl. No.: 908,151

[22] Filed: Jul. 2, 1992

[51] Int. Cl.[5] ..... F01P 7/04

[52] U.S. Cl. ..... 123/41.65; 74/572

[58] Field of Search ..... 123/41.11, 41.31, 41.48, 123/41.63, 149 D, 41.65; 74/572

[56] References Cited

U.S. PATENT DOCUMENTS

| | | | |
|---|---|---|---|
| 3,782,851 | 1/1974 | Harckbarth et al. | 415/213 |
| 4,134,370 | 1/1979 | Iwahashi et al. | 123/41.31 |
| 4,550,697 | 11/1985 | Campen | 123/149 D |
| 4,603,664 | 8/1986 | Jackson | 123/149 D |
| 4,606,305 | 8/1986 | Campen | 123/149 D |
| 4,982,705 | 1/1991 | Hudson | 123/41.65 |

FOREIGN PATENT DOCUMENTS

| | | | |
|---|---|---|---|
| 109962 | 4/1900 | Fed. Rep. of Germany | 123/41.65 |

*Primary Examiner*—Noah P. Kamen

*Attorney, Agent, or Firm*—Michael, Best & Friedrich

[57] ABSTRACT

Disclosed herein is a flywheel comprising a hub, a flange extending from the hub and including a central portion having an under surface, an outer surface, a plurality of openings extending through the central portion in a circular array, and a like plurality of vanes which are inclined in the direction from the outer surface toward the under surface and in a first rotary direction opposite to a second or intended direction of flywheel rotation, which are respectively located between the openings, and which respectively include an outer surface extending from the central portion outer surface to the central portion under surface, and an under surface extending from the central portion outer surface to the central portion under surface in generally parallel spaced relation to the vane outer surface, whereby, and in response to flywheel rotation in the intended rotary direction, air is engaged by the vane under surfaces and forced axially in the direction from the outer surface of the central portion to the under surface of the central portion.

3 Claims, 1 Drawing Sheet

AXIAL FAN FLYWHEEL

BACKGROUND OF THE INVENTION

The invention relates generally to flywheels and more particularly to flywheels which are also constructed to act as fans.

Attention is directed to U.S. Pat. 5,078,101 which issued Jan. 7, 1992, and which discloses a flywheel which is of inverted cup shape defining a recess in which heat generating ignition components are located. The construction disclosed in U.S. Pat. 5,078,101 includes a circular array of openings in a series of vanes or fins which project upwardly from the top or upper surface of the flywheel and which function like a centrifugal fan and act to cause air flow outwardly through the openings and from the interior of the recessed interior of the cup shaped portion of the flywheel. The fins or vanes also act to centrifugally displace air above the flywheel and thus less then the maximum air flow from the interior recess of the flywheel is achieved, with consequent diminishment of possible heat removal.

Attention is also directed to the following U.S. patents:

| | | |
|---|---|---|
| 3,782,851 | Hackbarth, et al. | January 01, 1974 |
| 4,134,370 | Iwahashi, et al. | January 16, 1979 |
| 4,550,697 | Campen | November 05, 1985 |
| 41603,664 | Jackson | August 05, 1986 |
| 4,606,305 | Campen | August 19, 1986 |

SUMMARY OF THE INVENTION

The invention provides a flywheel comprising a hub portion having an axis, an inner end, and an outer end spaced axially from the inner end, an inner flange portion extending radially outwardly from the outer end of the hub portion in generally perpendicular relation to the axis of the hub portion and having a radially outer periphery, a generally cylindrical wall portion extending from the outer periphery of the inner flange portion in generally spaced relation to the hub portion and in generally parallel relation to the axis of the hub portion and in the direction toward the inner end of the hub portion from the outer end of the hub portion and including an end axially spaced from the outer end of the hub portion, whereby to define a recess defined between the hub portion, the cylindrical wall portion, and the inner flange portion, an outer flange portion extending radially outwardly from the end of the cylindrical wall portion in generally perpendicular relation to the axis of the hub portion, and means including a plurality of vanes structured to displace air in the direction of the axis of the hub portion from the outer end of the hub portion to the inner end of the hub portion and relative to the recess.

The invention also provides a flywheel comprising a hub, a flange extending from the hub and including a central portion having an under surface, an outer surface, a plurality of openings extending through the central portion in a circular array, and a like plurality of vanes which are inclined in the direction from the outer surface toward the under surface and in a first rotary direction opposite to a second or intended direction of flywheel rotation, which are respectively located between the openings, and which respectively include an outer surface extending from the central portion outer surface to the central portion under surface, and an under surface extending from the central portion outer surface to the central portion under surface in generally parallel spaced relation to the vane outer surface, whereby, and in response to flywheel rotation in the intended rotary direction, air is engaged by the vane under surfaces and forced axially in the direction from the outer surface of the central portion to the under surface of the central portion.

The invention also provides a flywheel comprising a hub portion having an axis, an inner end, and an outer end spaced axially from the inner end, a central flange portion extending radially outwardly from the outer end of the hub portion in generally perpendicular relation to the axis of the hub portion and having an under surface, an outer surface spaced axially from the under surface, a radially outer periphery, a circular segment inwardly of the outer periphery, a plurality of openings extending axially through the circular segment and located in a circular array, and a like plurality of inclined surfaces located in the circular segment in respectively adjacent relation to the openings and extending, in inclined relation, from the outer surface to the under surface, whereby the openings have axial extent as well as horizontal extent, a generally cylindrical wall portion extending from the outer periphery of the central flange portion in generally spaced and parallel relation to the hub portion and in the direction toward the inner end of the hub portion from the outer end of the hub portion and including an end axially adjacent the inner end of the hub portion, and an outer flange portion extending radially outwardly from the end of the cylindrical wall portion in generally perpendicular relation to the axis of the hub portion.

Other features of and advantages of the invention will become apparent to those skilled in the art upon review of the following detailed description, claims, and drawings.

THE DRAWINGS

Figure 1:
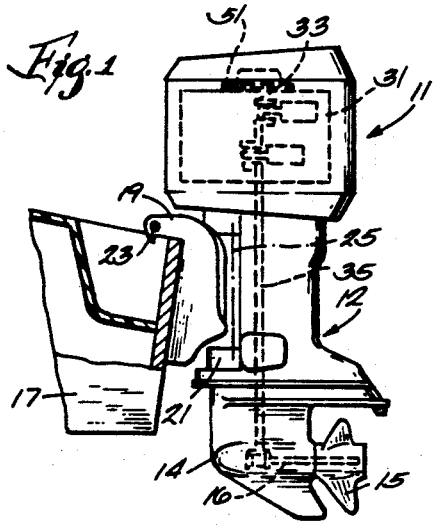
FIG. 1 is a perspective view of a marine propulsion device which is in the form of an outboard motor and which incorporates a flywheel embodying various of the features of the invention.
Figure 4:
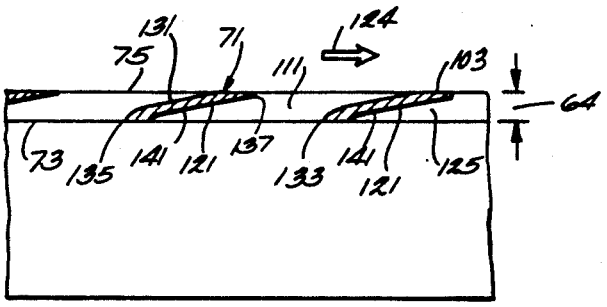
FIG. 4 is an enlarged view taken generally along line 4—4 of FIG. 3.
Figure 2:
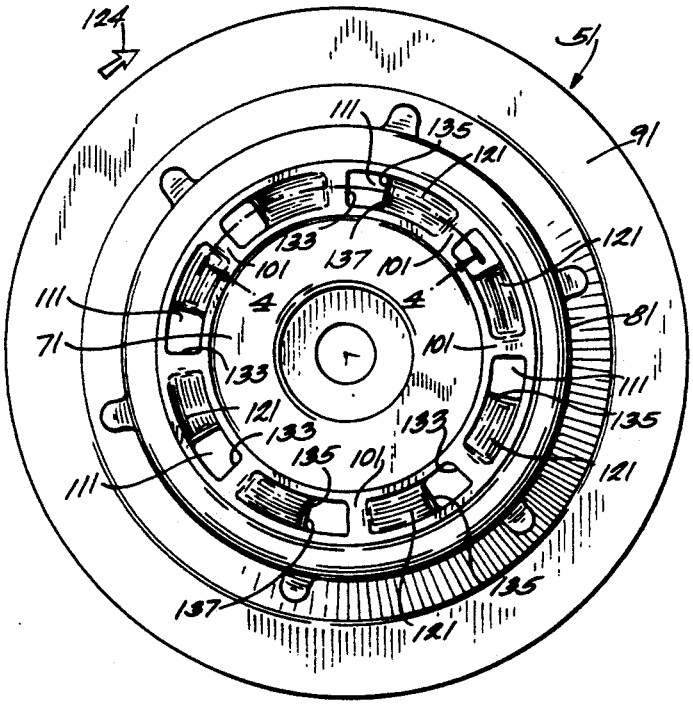
FIG. 2 is an enlarged view, from above, of the flywheel incorporated in the outboard marine as shown in FIG. 1.
Figure 3:
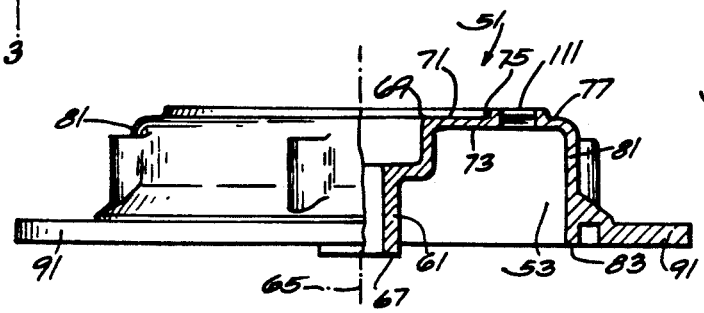
FIG. 3 is a partially broken away sectional view taken along line 3—3 of FIG. 2.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 is a marine propulsion device 11 which is in the form of an outboard motor and which comprises a propulsion unit 12 including a gear case 14 supporting a propeller shaft 16 for rotary movement. Fixed on the propeller shaft 16 for common rotation therewith is a propulsion element in the form of a propeller 15.

In one embodiment, the propulsion unit 12 is pivotally attached to a water craft 17 by means including a stern bracket 19 which is fixed to the watercraft 17 and a swivel bracket 21 which is connected to the stern bracket 19 for rotation about a generally horizontal axis 23 and connected to the propulsion unit 12 for common pivotal movement about the horizontal axis 23 and for pivotal movement of the propulsion unit 12 relative to the swivel bracket 21 about a generally vertical axis 25.

Above the gear case, the propulsion unit 12 comprises a power head including an internal combustion engine 31 including a crankshaft 33 drivingly connected to the propeller shaft 16 by a vertical drive shaft 35. In addition, the propulsion unit 12 includes a flywheel 51 which is mounted on the upper end of the crankshaft 33. The flywheel 51 includes a cup shaped recess or interior 53, and means for axially displacing air into the recess 53 from above.

More particularly, the flywheel 51 preferably is of one piece integrally cast construction and includes a hub portion 61 which is adapted to be mounted on the crankshaft 33, as generally shown in U.S. Pat. 5,078,101, for rotation about an axis 65 and which includes an inner or lower end 67 and an upper or outer end 69. The flywheel 51 also includes a central or inner flange portion 71 which extends radially outwardly from the upper or outer end 69 of the hub portion 61 in generally perpendicular relation to the axis 65 of hub rotation and which, in general, has a thickness 64. The central flange portion 71 also includes an inner or under surface 73 and an outer or upper surface 75, as well as a radially outer periphery 77.

The flywheel 51 also includes a generally cylindrical wall portion 81 which extends from the radially outer periphery 77 of the central flange portion 71 in generally spaced and parallel relation to the hub portion 61 and in the direction from the outer end 69 of the hub portion 61 toward the inner end 67 thereof. The cylindrical wall portion 81 also includes an lower end 83 located axially adjacent the inner or lower end 67 of the hub portion 61.

The flywheel 51 also includes an outer flange portion 91 which extends radially outwardly from the lower end 83 of the cylindrical wall portion 81 in generally perpendicular relation to the axis 65 of hub rotation and which can include a toothed periphery (not shown).

The flywheel 51 also includes means located in the central flange portion 71 and operable, in response to flywheel rotation, to axially force air from above the flywheel 51 into the cup shaped space or recess 53 within the flywheel 51. The air which is axially so forced into the recess 53 escapes from the lower end of the recess 53 and passes radially outwardly under the lower end 83 of the cylindrical central portion 81 and below the outer flange portion 91, thereby carrying away heat generated by the ignition components (not shown) located in the cup shaped recess or interior 53 of the flywheel 51.

While other specific constructions can be employed, in the disclosed construction, such means comprises, in the central flange portion 71, a circular segment 101 which includes an upper surface 103 in adjacent or generally coplanar relation of the upper surface 75 of the central flange portion 71. The means for axially forcing air into the interior or recess 53 of the flywheel 51 also includes a plurality of openings 111 which are located in a circular array in the circular segment 101 and which extend axially through the circular segment 101 of the central flange portion 71, and a like plurality of vanes 121 which are located in a circular array in the circular segment 101 of the central flange portion 71 and between the openings 111 and which are axially inclined so as, in response to flywheel rotation, to force air through the openings 111 from above the flywheel 51 and into the recess 53. As it is contemplated that the flywheel 51 will rotate in the clockwise direction 124, as seen from above, the inclined vanes 121 extend downwardly and in the counterclockwise direction from the upper surface 103 of the circular segment 101 of the central flange portion 71 and into the circular void 125 immediately below the upper surface 103.

More specifically, each of the vanes 121 is identical and each includes an upper surface 131 which extends from the upper surface 103 of the circular segment 101 in spaced relation from the trailing end 133 of one of the openings 111 and has an opposite or spaced end 135 which terminates at the undersurface 73 and which is located in spaced relation to the leading end 137 of the next adjacent opening 111. Thus, the openings 111 are defined with both horizontal and vertical extent. The vanes 121 also include an under surface 141 which extends from the surface 103 of the circular segment 101 of the central flange portion 71 at the trailing end 133 of the associated opening 111 and in spaced, generally parallel relation to the vane upper surface 131 and which terminates at the inner lower or under surface 73 of the central flange portion 71. More particularly, the vane surface 131 and 141 are spaced at a distance less than the thickness 64. It is the vane under surfaces 141 which, during flywheel rotation, engages the air and axially displace the air inwardly into the recess 53.

In operation, and in response to flywheel rotation, a greater air flow is forced axially into the recess 53 as compared with the arrangement disclosed in U.S. Pat. No. 5,078,101, which greater air flow is more effective in removing the heat generated by the ignition components (not shown) in the recess 53.

Various of the features of the invention are set forth in the appended claims.

I claim:

1. A flywheel comprising a hub portion having an axis, an inner end, and an outer end spaced axially from said inner end, an inner flange portion extending radially outwardly from said outer end of said hub portion in generally perpendicular relation to the axis of said hub portion and having a radially outer periphery, a generally cylindrical wall portion extending from said outer periphery of said inner flange portion in generally spaced relation to said hub portion and in generally parallel relation to the axis of said hub portion and in the direction toward said inner end of said hub portion from said outer end of said hub portion and including an end axially spaced from said outer end of said hub portion, whereby to define a recess defined between said hub portion, said cylindrical wall portion, and said inner flange portion, an outer flange portion extending radially outwardly from said end of said cylindrical wall portion in generally perpendicular relation to the axis of said hub portion, and means including a plurality of vanes structured to displace air in the direction of the axis of said hub portion from the outer end of the hub portion to the inner end of the hub portion and relative to said recess.

2. A flywheel comprising a hub, a flange extending from said hub and including a central portion having an under surface, an outer surface, a plurality of openings extending through said central portion in a circular array, and a like plurality of vanes which are inclined in the direction from said outer surface toward said under surface and in a first rotary direction opposite to a second or intended direction of flywheel rotation, which are respectively located between said openings, and which respectively include an outer surface extending from said central portion outer surface to said central portion under surface, and an under surface extending from said central portion outer surface to said central portion under surface in generally parallel spaced relation to said vane outer surface, whereby, and in response to flywheel rotation in the intended rotary direction, air is engaged by said vane under surfaces and forced axially in the direction from said outer surface of said central portion to said under surface of said central portion.

3. A flywheel comprising a hub portion having an axis, an inner end, and an outer end spaced axially from said inner end, a central flange portion extending radially outwardly from said outer end of said hub portion in generally perpendicular relation to the axis of said hub portion and having an under surface, an outer surface spaced axially from said under surface, a radially outer periphery, a circular segment inwardly of said outer periphery, a plurality of openings extending axially through said circular segment and located in a circular array, and a like plurality of inclined surfaces located in said circular segment in respectively adjacent relation to said openings and extending, in inclined relation, from said outer surface to said under surface, whereby said openings have axial extent as well as horizontal extent, a generally cylindrical wall portion extending from said outer periphery of said central flange portion in generally spaced and parallel relation to said hub portion and in the direction toward said inner end of said hub portion from said outer end of said hub portion and including an end axially adjacent said inner end of said hub portion, and an outer flange portion extending radially outwardly from said end of said cylindrical wall portion in generally perpendicular relation to the axis of said hub portion.

* * * * *